US006592426B2

(12) United States Patent
Mesch

(10) Patent No.: US 6,592,426 B2
(45) Date of Patent: Jul. 15, 2003

(54) AMUSEMENT DEVICE WITH FLEXIBLE RUBBERIZED POP UP FIGURE

(76) Inventor: Thomas J. Mesch, 271 18th St., Brooklyn, NY (US) 11215

( * ) Notice: Subject to any disclaimer, the term of this patent is extended or adjusted under 35 U.S.C. 154(b) by 0 days.

(21) Appl. No.: 09/768,836

(22) Filed: Jan. 24, 2001

(65) Prior Publication Data

US 2002/0098770 A1 Jul. 25, 2002

(51) Int. Cl.[7] ..... A63H 11/06
(52) U.S. Cl. ..... 446/310; 446/175
(58) Field of Search ..... 446/3, 9, 175, 446/486, 310, 311, 308–309, 297; 84/94.1; 472/54–56; D21/589

(56) References Cited

U.S. PATENT DOCUMENTS 230,502 A * 7/1880 Shepherd
821,468 A * 5/1906 Dashiell
2,858,644 A * 11/1958 Derham
3,691,675 A * 9/1972 Rodgers
4,205,483 A * 6/1980 Clark et al.
4,259,805 A * 4/1981 Hornsby, Jr.
4,407,504 A * 10/1983 Popov ..... 273/153 R

OTHER PUBLICATIONS www.liveandlearn.com, see attached.*
www.actionfigures.about.com, see attached.*
www.liveandlearn.com (see attached).*
Bill Jensen, "Out of the Box", Newsday, Monday, Feb. 21, 2000, Section B pp. B6–7.

* cited by examiner

*Primary Examiner*—Derris H. Banks
*Assistant Examiner*—Jamila Williams
(74) *Attorney, Agent, or Firm*—Keusey, Tutunjian & Bitetto, P.C.

(57) ABSTRACT

An amusement device includes a container having a releasable cover, which is biased by a compressible elastic member when the releasable cover is in a closed position. A molded rubber sheath encapsulates the compressed elastic member, and the rubber sheath provides a three dimensional figure which is collapsible in the closed position for storage in the container and which recovers to the three dimensional figure when released from the container. A release mechanism is provided in operative relationship with the releasable cover to permit the three dimensional figure to be released by the compressible elastic member when triggered by the release mechanism.

34 Claims, 5 Drawing Sheets

AMUSEMENT DEVICE WITH FLEXIBLE RUBBERIZED POP UP FIGURE

A portion of the disclosure of this patent document contains material, which is subject to copyright protection. The copyright owner has no objection to the facsimile reproduction by anyone of this patent document or the patent disclosure, as it appears in the U.S. Patent and Trademark Office patent file or records, but otherwise reserves all copyrights whatsoever.

BACKGROUND

1. Technical Field

This disclosure relates to pop up amusement devices, and more particularly, to a pop up toy having a flexible rubberized figure suitable for highly detailed features and suitable for painting.

2. Description of the Related Art

Jack-in-the-boxes are well known in the art. Conventional jack-in-the-boxes typically include a hand crank which when turned causes a mechanism to play a tune until a trigger releases the top of the box. Once released a spring loaded head pops out. The spring, which connects to the head, is typically covered by a loose fitting fabric. The fabric covers the spring but fails to provide a constant shape since the fabric is simply draped over the spring.

The fabric has not conventionally been an article of entertainment in itself. The entertainment value from such materials has for the most part emanated from the colorful patterns placed on them. The entertainment value associated with these conventional devices is the displacement of the actuating device after a predetermined amount of time or after a musical piece is played by turning a crank. In some instances, rigid plastic figures were employed to pop out of boxes; however, these rigid plastic figures were limited in size due to the size of the container from which they emerged.

Heretofore, it has not been known in the art to provide a non-fabric flexible pop up figure to heighten the shock value of releasing the pop up figure from a container. It has also not been known in the art to provide a non-fabric flexible pop up figure which has a height or width dimension greater than the dimension of the container from which the figure has emerged.

SUMMARY OF THE INVENTION

An amusement device includes a container having a releasable cover, which is biased by a compressible elastic member when the releasable cover is in a closed position. A molded rubber sheath encapsulates the compressed elastic member, and the rubber sheath provides a three dimensional figure which is collapsible in the closed position for storage in the container and which recovers to the three dimensional figure when released from the container. A release mechanism is provided in operative relationship with the releasable cover to permit the three dimensional figure to be released by the compressible elastic member when triggered by the release mechanism.

Another amusement device includes a container forming an enclosure and having a releasable cover, and a slider plate slidably engaging a portion of the enclosure, the slider plate being biased in a direction of the releasable cover. A compressible elastic member is mounted on the slider plate, and a molded rubber sheath encapsulates the compressed elastic member and secures to the slider plate on one end portion of the rubber sheath. The rubber sheath provides a three dimensional figure which is collapsible in a closed position for storage in the container and which recovers to the three-dimensional figure when released from the container. A release mechanism is disposed in operative relationship with the releasable cover to permit the three-dimensional figure to be released by the compressible elastic member and the biased slider plate when triggered by the release mechanism.

In alternate embodiments, the rubber sheath may include a silicon-based rubber. The silicon-based rubber may include KRATON. The container may include a height, H, and the three dimensional figure extends to a height of greater than 2 times H when released from the container. The compressed elastic member may extend vertically when released from the container and the rubber sheath may include a horizontally extending portion. The horizontally extending portion may extend beyond the container in a horizontal plane. The amusement may include a memory device for storing acoustical information such that the acoustical information is converted to sound by a speaker. The three-dimensional figure may include a molded image of a musician and the acoustical information includes music associated with the musician. The amusement device may include a light disposed in one of the container and the rubber sheath to provide lighting effects. The amusement device may include a pressure source in communication with an interior portion of the rubber sheath to permit increased pressure in the interior portion.

In other embodiments, the amusement device may include a vibration device coupled to the amusement device to produce vibrational motion of the three dimensional figure. The rubber sheath preferably provides a paintable surface. The rubber sheath may include a molded image having three-dimensional molded details. The three-dimensional details may include at least one of body features, personal effects and appendages. The three dimensional figure may include a molded image of one of a human, an animal, a fictional character, a cartoon character, a comic character, and a body part. The amusement device may include rigid parts attached to the rubber sheath and/or collapsible molded features connected to the rubber sheath. The collapsible molded features may include air holes to permit recovery of the collapsible molded features when the three dimensional figure is released.

These and other objects, features and advantages of the present invention will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

The present invention provides a pop up figure formed from a rubberized flexible sheath. The rubberized sheath provides a flexible body, which holds its shape when released from its container. The flexible sheath provides molded three-dimensional features which results in a highly detailed and highly realistic three dimensional form. The flexible sheath of the present invention advantageously provides the capability of being painted, which enhances the detail and the shock value of the emerging pop up figure. For example, blood may be painted on horror figures, or fluorescent paints may be employed for glow in the dark effects etc. The three dimensional form which emerges from a container appears realistic due to the high level of detail in the molded flexible sheath. Three-dimensional details may be formed in the flexible sheath, such as musculature, clothing, armor, hair, padding, or any other personal effects. The present invention will now be described in terms of illustrative examples; however, the present invention should not be construed as limited by these examples.

Figure 1:
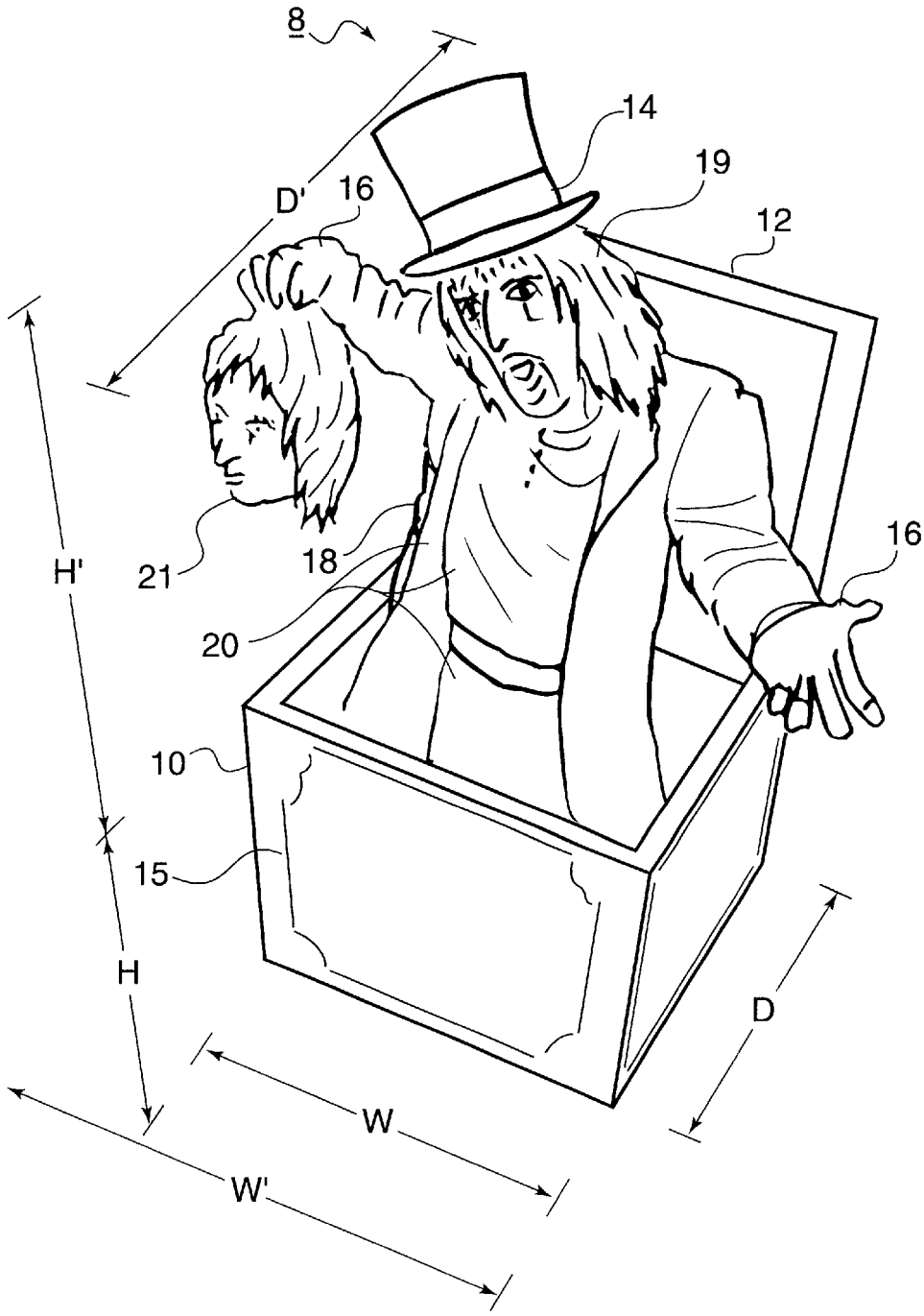
FIG. 1 is a perspective view of a pop up amusement toy in accordance with one embodiment of the present invention.

Referring now in specific detail to the drawings in which like reference numerals identify similar or identical elements throughout the several views, and initially to FIG. 1, a perspective view of an illustrative embodiment of a pop up toy 8 of the present invention is shown. A box 10 or other container (e.g., a cylinder, a sphere, an egg or any other shaped container) is shown with a lid or cover 12 released and a figure 14 emerging from box 10. Box 10 includes dimensions H (height), W (width), and D (depth). In accordance with the present invention, figure 14 is collapsible to fit inside box 10 with dimensions H, W and D.

Once released from box 10, figure 14 includes dimension H', W' and D'. Any one or all of dimensions H', W' and D' may be greater than box dimensions H, W, and/or D. In preferred embodiments, H' is greater than H, and more preferably H' is greater than 2H. figure 14 may include appendages or other extended features 16, which spring outward from a torso or main portion 18 of figure 14. Extended features 16 preferably provide figure 14 with a width W' of greater than W. Extended features 16 may also extend in the direction of D and provide figure 14 with a depth D' which extends beyond a front face 15 of box 10.

Figure 14 includes a flexible sheath 20, which covers a bias member (not shown), such as a spring or other elastic member, to permit figure 14 to pop out from box 10. Flexible sheath 20 may include a silicon-based rubber, such as, for example, KRATON. In a preferred embodiment, flexible sheath 20 includes an injection moldable silicon based rubber. Other flexible materials may be employed which provide flexibility while maintaining three-dimensional details of figure 14. Silicon based rubbers are not preferred in the art for flexible applications since problems arise from cracking or memory in the material. However, the inventor of the present invention employs silicon-based rubber by adjusting thicknesses of sheath 20 at predetermined flex points thus providing resistance to cracking and memory. In addition, fiber materials may be added before or during molding to provide increased capabilities of sheath 20. Further, silicon based rubber compounds provide sufficient mold detail to provide highly detailed three-dimensional images for figure 14. Sheath 20 is also capable of being painted to provide an even more detailed figure 14.

Sheath 20 of figure 14 may include a unitary or single piece or may be comprised of a plurality of pieces, which may be comprised of a plurality of parts. For example, a head 19 of figure 14 may include a rigid moldable plastic piece such as polyvinyl chloride (PVC) or other rigid plastic material. A rigid head or other part of figure 14 may provide structural support or permit different colors or features to be introduced on figure 14. For example, a rigid plastic part 21 may be carried or attached to an appendage 16 or other portion of figure 14.

Figure 14 may include a human or animal likeness, a mythical character or superhero or any other famous or infamous character, etc. In preferred embodiments, figure 14 may include a rock star, model, sports figure, cartoon character, a monster, an actor/actress or the like. figure 14 may be dressed up, painted or otherwise detailed in the likeness of a subject character.

Figure 2:
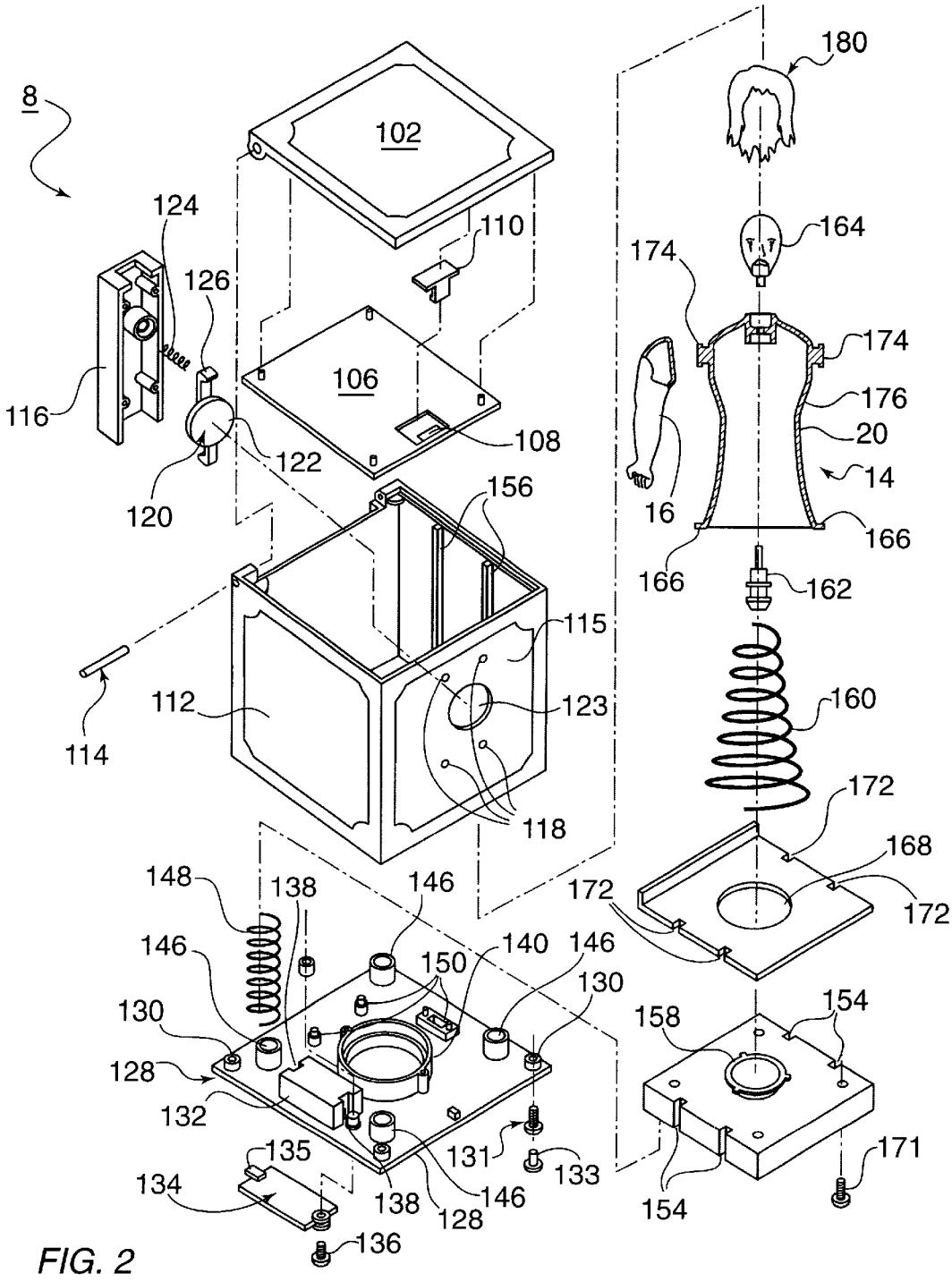
FIG. 2 is an exploded perspective view with parts separated of an illustrative embodiment of the present invention.

Referring to FIG. 2, an exploded view of pop up toy 8 is shown in accordance with one embodiment of the present invention. A top cover 102 of box 10 (FIG. 1) is shown. A plate 106 is attached to top cover 102 by a snap fit or other suitable connection. A recess and/or hole 108 formed in plate 106 receives a release hook 110 or other fastener therein. Release hook 110 is secured between top cover 102 and plate 106. Top cover 102 is hingedly connected to a box body 112 by employing hinge axles 114 (only one shown for simplicity). A spring press member 116 is attached to the inside of a front face 115 of box body 112. Member 116 may include snap-on fasteners or provide threaded holes for screws (not shown) which may be received through holes 118 in face 115.

A release mechanism 120, which may include, for example, a button 122, is mounted between spring press member 116 and front face 115. Button 122 is biased by a button spring 124. Button 122 is presented through hole 123 in face 115 so that button 122 can be pressed to activate release mechanism 120. Release mechanism 120 includes a hook portion 126, which engages hook 110 when toy 8 is assembled. When button 122 is pressed hook portion 126 and hook 110 disengage, top cover 102 is released, and the biased contents of box body 112 pop out. It is to be understood that other release mechanisms may be employed as well. For example, instead of button 122, knobs, sliders, cams or other devices may be employed to displace hook portion 126, as would be understood by one skilled in the art. Other mechanisms for releasing figure 14 may include triggers on opposite sides of box body 112 which when depressed simultaneously release figure 14. In alternate embodiments, the box body may open in other directions in addition to or instead of top cover 102 opening to release figure 14.

Top cover 102 and box body 112 may be decorated with images, photos, stickers, decals, paint or any other decorations or add-ons. Top cover 102 and box body 112 may be translucent or include cut-aways or a combination thereof to project light from box body 112, if equipped with light devices. Top cover 102 and box body 112 may be includes three dimensional relief portions to enhance the appearance of toy 8 or provide functional characteristics.

A bottom cover 128 includes a plurality of features employed for mounting circuitry, integrated circuit chips, power storage devices, such as batteries, a speaker, switch recesses and any other devices or features. Bottom cover 128 includes holes 130 for screws 131 employed to attach bottom cover 128 to box body 112. Bottom pins 133 may be employed to support toy 8. Bottom pins may include a rubber material or any other suitable material.

Bottom cover 128 includes a battery recess 132 for stowing a battery (not shown) for powering circuitry or chips employed in accordance with the present invention. Battery recess 132 may be integrally formed in bottom cover 132 or may be a separate part attached by a screw or other fastener to bottom cover 128. In either case, battery recess 132 provides access thereto through a bottom surface of bottom cover 128. Battery recess 132 preferably includes a battery door 134, which closes the battery compartment. Battery door 134 may include a screw hole or other locking device and a tab 135 to permit battery door 134 to be secured by a screw 136 or other fastening device to close off the battery compartment. Wire holes 138 are provided through the walls of battery recess 132 to permit an electrical connection to the battery. In alternate embodiments, toy or device 8 may be adapted to receive power from an AC/DC power outlet to enable more power or accommodate more features or functions.

Bottom cover 128 includes a feature 140 for receiving a speaker (not shown). Holes 142 are provided through bottom cover to permit sound to exit box body 112. Fasteners 144 are employed to secure a speaker in feature 140. Projections 146 are employed to secure one end of compression springs 148 (only one compression spring 148 is shown for simplicity). Other pins or features 150 may be formed or attached to bottom cover 128 to permit chips, other circuitry, switches (e.g., on/off switches) or other devices to be secured within box body 112.

The other end of compression springs 148 is secured to a slider plate 152 to bias slider plate 152 toward top cover 102 when assembled. Slider plate 152 includes grooves 154, which receive tracks 156 formed on inside walls of box body 112. Tracks 156 and grooves 154 provide a stable sliding motion when top cover 102 is opened as actuated by the bias of springs 148.

Slider plate 152 includes a base portion 158 for securing a lower end portion of a tapered spring 160. In the embodiment shown, a mushroom joint or other attachment device 162 may be secured to the other end portion of tapered spring 160. Mushroom joint 162 passes through flexible sheath 20, connects to, and secures a rigid head 164 for figure 14. Flexible sheath 20 includes tabs or extended portions 166 on a bottom portion. Sheath 20 is installed through a hole 168 formed through a press plate 170. Tabs 166 are sandwiched and secured between press plate 170 and slider plate 152 by screws 171. This secures figure 14 to slider plate 152 and ensures that tapered spring 160 biases sheath 20 against tabs 166 when figure 14 pops out from box body 112. Grooves 172 may be provided in press plate 170 to receive tracks 156.

Sheath 20 and may include features 174 for attaching other portions of figure 14. For example, appendages 16 may be attached to features 174. Alternately, sheath 20 may include a single unitary piece, which includes appendages and head. Additional springs or elastic materials may be employed and attached between appendages 16 and body portion 176 of sheath 20. Sheath 20 preferably includes a silicon-based rubber. Depending on the desired motion, stress points and physical characteristics desired of figure 14, thickness of sheath 20 may be varied accordingly. Material thicknesses of sheath 20 may preferably be between about 0.015 inches to about 0.25 inches. The thicknesses and features employed for sheath 20 advantageously permit figure 14 to have a form or shape which is collapsible when stored in box 10 and recovers when launched from box 10. In other words, a particular shape or form is provided by sheath 20 despite its collapsible capability. Sheath 20 preferably includes three-dimensional details formed, preferably by molding, on its surface. These details may be employed externally or internally to sheath to increase thicknesses of sheath 20 at particular positions or to provide decorative or functional details to the appearance of figure 14.

Other features 180 may also be added to figure 14. For example, real or fake hair or a hat (FIG. 1) may be added to head 164, or a tool, instrument, sports apparatus, microphone or other apparatus may be placed in the hand of appendage 16. Features 180 or 21 (FIG. 1) may be collapsible or rigid depending on the embodiment. Box body 112, top cover 102, slider plate 152, press plate 170 and/or bottom cover 128 may be formed from plastic such as polyethylene or other moldable plastic, from wood, from metal or from any other suitable material.

Figure 3:
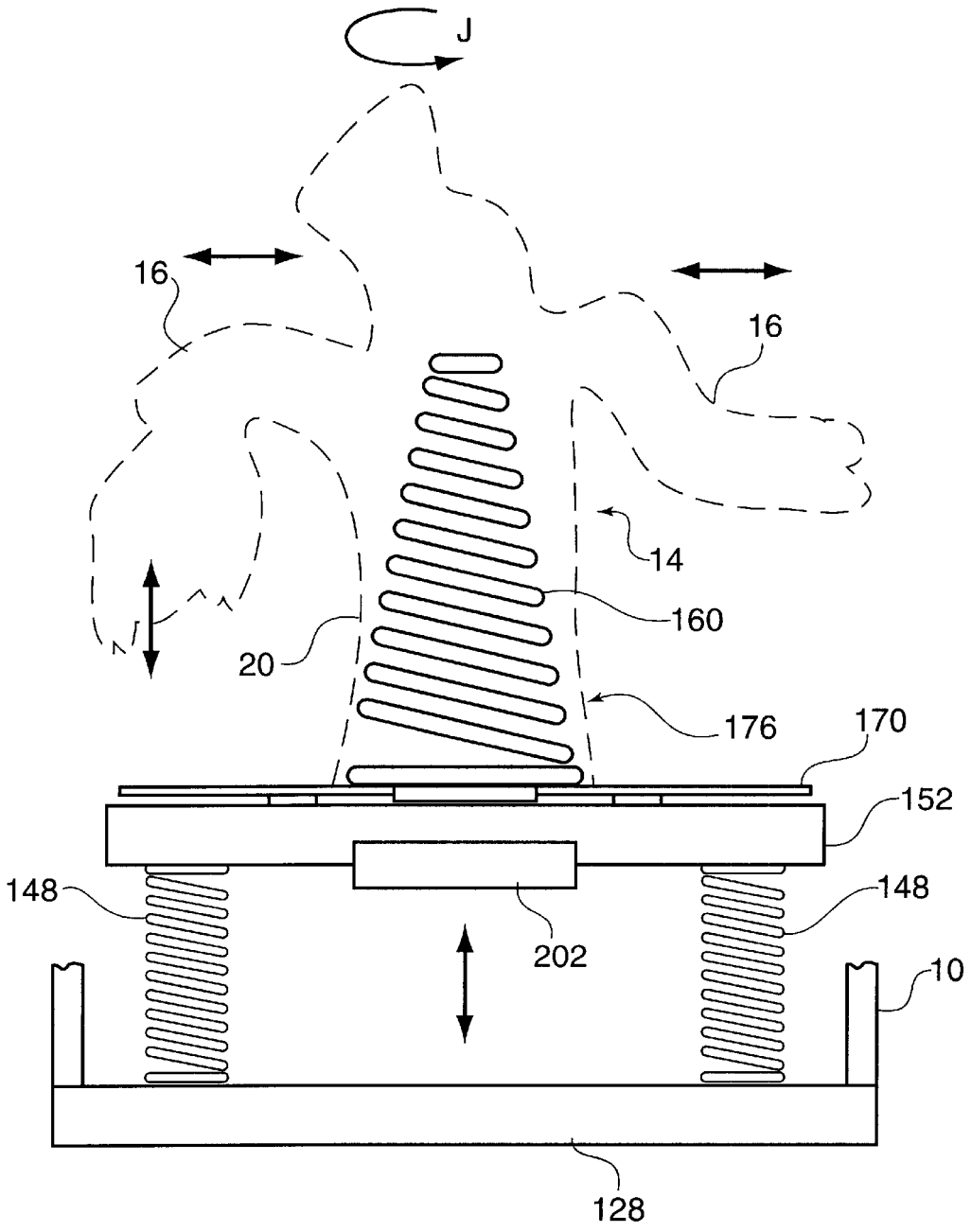
FIG. 3 is a side schematic view of an illustrative launching mechanism in accordance with one embodiment of the present invention.

Referring to FIG. 3, a schematic diagram is shown for launching figure 14 stored in box 10. In a collapsed form, figure 14 is compressed to fit inside box 10. Tapered spring 160 and compression springs 148 are compressed. When top plate 102 is released, spring 160 and springs 148 are simultaneously released causing figure 14 to both rise up out of box 10 and become upright. The size, features and coloration of figure 14 may advantageously be employed to increase the shock value experienced by a user. Springs 148 move slider plate 152 upward toward the top of box 10 and permit the bottom of figure 14 to be as close to the top of box body 112 (FIG. 2) to maximize the height of figure 14.

To further increase shock value, appendages or other features 16 may extend upward and/or outward from body portion 176. Appendages 16 spring outward or oscillate causing a significant amount of motion for figure 14. Other features, which may be added to increase both shock value and entertainment value may include the use of a memory, chip which stores music or sound effects. When figure 14 is released, music or sound effects are played. The music or sound effects may correspond to the type of figure 14 employed. For example, if figure 14 is a werewolf, wolf-like sounds may be provided, or if figure 14 is musician, a sound byte or musical piece related to that musician may be played.

To increase deployment speed, an optional air source 202 may be employed to fill sheath 20 during deployment. Source 202 may include a compressed air tank, for example, a carbon dioxide cartridge employed for air guns, or may include a fan in slider plate 152 which increases air pressure in sheath 20. Air source 202 may be mechanically or electrically activated during the release of figure 14 by, e.g., pressing button 122.

In an alternate embodiment, air source 202 may include a fan or a motor capable of permitting figure 14 to rotate in the direction of arrow "J". Motor 202 may begin to rotate upon release of figure 14 or begin to rotate after a delay (to permit deployment of figure 14) or a period delay (once figure 14 is released).

Figure 4C:
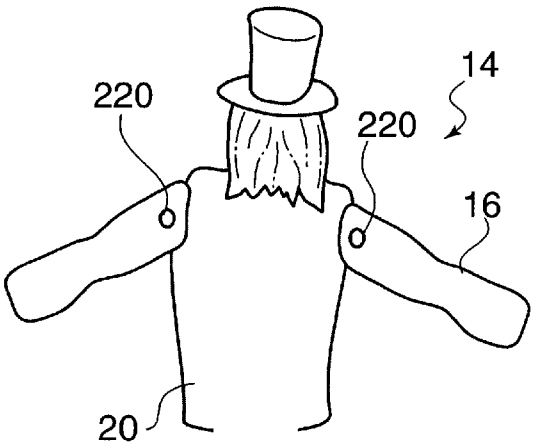
FIGS. 4A–C depict rear views of figures of the present invention having attachable collapsible appendages showing air vents for improving recovery of the appendages after deployment in accordance with the present invention.
Figure 4B:
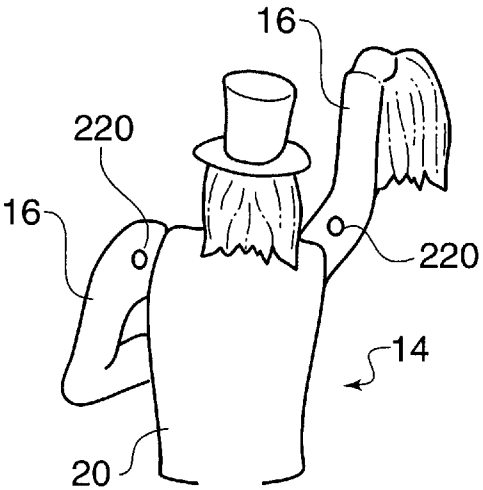
Figure 4A:
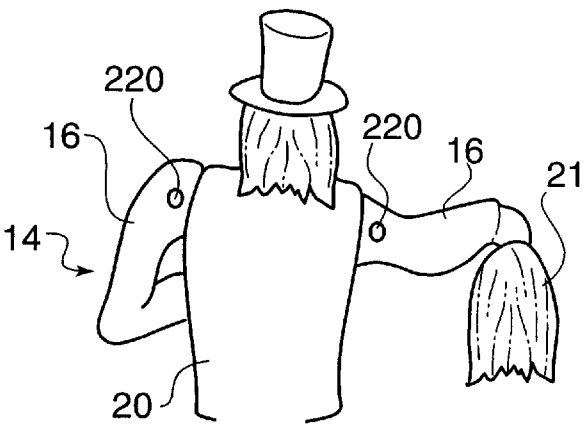

Referring to FIGS. 4A–C, in embodiments of the present invention which employ multiple pieces for figure 14, appendages 16 and the like, may be completely compressed prior to release of figure 14 from box 10 (FIG. 1). To increase recovery of such appendages 16, air holes or vents 220 may be employed through flexible rubber appendages 16 to reduce recovery time of these portions.

Figure 5:
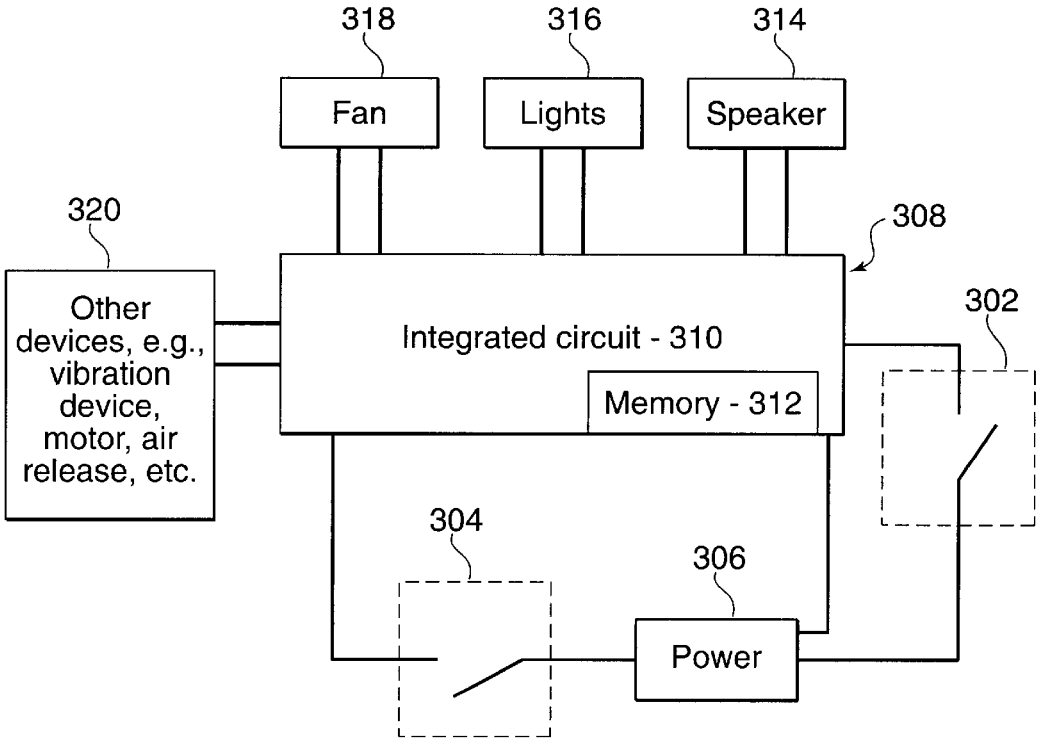
FIG. 5 is a schematic block diagram showing circuitry in accordance with the present invention.

Referring to FIG. 5, an illustrative schematic diagram is shown for circuitry employed in accordance with the present invention. A button or other device 122 includes a switch 302. It is to be understood that other device 122 may include, for example, a motion sensor, a light sensor, a sound sensor, etc. which may be provided to trigger the release of figure 14 (e.g., by employing a solenoid or electrically actuated device). In this way, the mechanical release of figure 14 may be provided as described above or actuated electrically. Switch 302 is closed by either method to permit toy 8 to be electrically activated. Switch 302 is closed momentarily upon releasing figure 14 from box 10. If an on/off switch 304 is closed (turned on), a power source 306, such as a battery, AC/DC power or other power source, supplies power to a circuit 308, preferably an integrated circuit chip 310. Chip 310 is initially activated or enabled by switch 302 and then draws power directly from battery 306 for a predetermined duration, such as the length of a song stored in a memory portion 312 of chip 310 to be played by a speaker 314. When the event or predetermined amount of time lapses power from battery 306 is shut off until switch 302 is closed again. Chip 310 and/or memory portion 312 may be removable and interchangeable so that different sound bytes, songs or effects may be introduced into toy 8. Chip 310 may be adapted to record original sounds provided by a user. Conventional microphone and recording technology may be employed to provide this feature on toy 8.

Chip 310 may perform a plurality of functions including playing music or sound effects through speaker 314, activating lights 316 or activating a fan 318 or other device 320 in box 10. Lights 316 may include lights stored within sheath 20 (including, e.g., head 164) or in box 10. Wiring for lights 316 in sheath 20, appendages 16 or head 164 preferably includes sufficient slack to permit proper motion of figure 14 (e.g., from a collapsed state to a deployed state). Lights 316 may be employed to light up the eyes of figure 14, light up an object held by a figure 14 or any other effect desired for a particular figure 14. Fan 318 may be employed to increase internal air pressure in sheath 20 or may be employed to provide a sustained effect, for example, provide motion of a cape on a deployed superhero or the hair of a rock star for an embodiment of figure 14.

Other devices 320 may include, for example, an unbalanced fan or other vibration device, a motor for rotating figure 14 or part of figure 14 (e.g., the head portion) or a device for releasing air from a replaceable air tank 222. A vibration device may be provided to cause a rocking or vibrational effect, which may be imparted to figure 14. In one embodiment, the vibration device is mounted on slider plate 152. Slider plate 152 may include a rocker mechanism (e.g., a lever and fulcrum). This would provide additional motion to cause shaking of appendages or side to side motion of FIG. 14 and contribute to the overall effect of toy 8. This is particularly advantageous when rubber based materials are employed for figure 14.

Memory portion 312 may include read only memory or programmable memory. Memory portion 312 may be employed to store music, sounds, or programmed information employed for toy 8 (e.g., timing information for various devices to select which devices are employed at a given time). It should be understood that chip 310 may be employed with other chips or memory devices to provide additional effects or capabilities for toy 8. Chip 310 may include an application specific integrated circuit (ASIC), a microprocessor chip or any other chip with suitable functionality. Other functions, which may be integrated in to the present invention, may include, for example, motion sensors or light sensors for triggering the release of figure 14.

Having described preferred embodiments for amusement device with flexible rubberized pop up figure (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. An amusement device, comprising:

a container having a releasable cover which is biased by a compressible elastic member when the releasable cover is in a closed position;

a molded rubber sheath encapsulating the compressible elastic member, the molded rubber sheath providing a three dimensional figure which is collapsible in the closed position for storage in the container and which recovers to the three dimensional figure when released from the container; and a release mechanism in operative relationship with the releasable cover to permit the three-dimensional figure to be released by the compressible elastic member when triggered by the release mechanism.

2. The amusement device as recited in claim 1, wherein the rubber sheath includes a silicon based rubber.

3. The amusement device as recited in claim 1, wherein the container includes a height, H, and the three dimensional figure extends to a height of greater than 2 times H when released from the container.

4. The amusement device as recited in claim 1, wherein the compressible elastic member extends vertically when released from the container and the rubber sheath includes a horizontally extending portion.

5. The amusement device as recited in claim 4, wherein the horizontally extending portion extends beyond the container in a horizontal plane.

6. The amusement device as recited in claim 1, further comprising a memory device for storing acoustical information such that the acoustical information is converted to sound by a speaker.

7. The amusement device as recited in claim 6, wherein the three-dimensional figure includes a molded image of a musician and the acoustical information includes music associated with the musician.

8. The amusement device as recited in claim 1, further comprising a light disposed in one of the container and the rubber sheath to provide lighting effects.

9. The amusement device as recited in claim 1, further comprising a pressure source in communication with an interior portion of the rubber sheath to permit increased pressure in the interior portion.

10. The amusement device as recited in claim 1, further comprising a vibration device coupled to the amusement device to produce vibrational motion of the three dimensional figure.

11. The amusement device as recited in claim 1, wherein the rubber sheath provides a paintable surface.

12. The amusement device as recited in claim 1, wherein the rubber sheath includes a molded image having three-dimensional molded details.

13. The amusement device as recited in claim 12, wherein the three-dimensional details include at least one of body features, personal effects and appendages.

14. The amusement device as recited in claim 1, wherein the three dimensional figure includes a molded image of one of a human, an animal, a fictional character, a cartoon character, a comic character, and a body part.

15. The amusement device as recited in claim 1, further comprising rigid parts attached to the rubber sheath.

16. The amusement device as recited in claim 1, further comprising collapsible molded features connected to the rubber sheath.

17. The amusement device as recited in claim 16, wherein the collapsible molded features include air holes to permit recovery of the collapsible molded features when the three dimensional figure is released.

18. An amusement device, comprising:

a container forming an enclosure and having a releasable cover;

a slider plate slidably engaging a portion of the enclosure, the slider plate being biased in a direction of the releasable cover;

a compressible elastic member mounted on the slider plate;

a molded rubber sheath encapsulating the compressible elastic member and secured to the slider plate on one end portion of the rubber sheath, the rubber sheath providing a three dimensional figure which is collapsible in a closed position for storage in the container and which recovers to the three dimensional figure when released from the container; and a release mechanism in operative relationship with the releasable cover to permit the three-dimensional figure to be released by the compressible elastic member and the slider plate when triggered by the release mechanism.

19. The amusement device as recited in claim 18, wherein the rubber sheath includes a silicon based rubber.

20. The amusement device as recited in claim 18, wherein the container includes a height, H, and the three dimensional figure extends to a height of greater than 2 times H when released from the container.

21. The amusement device as recited in 18, wherein the compressible elastic member extends vertically when released from the container and the rubber sheath includes a horizontally extending portion.

22. The amusement device as recited in claim 21, wherein the horizontally extending portion extends beyond the container in a horizontal plane.

23. The amusement device as recited in claim 18, further comprising a memory device for storing acoustical information such that the acoustical information is converted to sound by a speaker.

24. The amusement device as recited in claim 23, wherein the three dimensional figure includes a molded image of a musician and the acoustical information includes music associated with the musician.

25. The amusement device as recited in claim 18, further comprising a light disposed in one of the container and the rubber sheath to provide lighting effects.

26. The amusement device as recited in claim 18, further comprising a pressure source in communication with an interior portion of the rubber sheath to permit increased pressure in the interior portion.

27. The amusement device as recited in claim 18, further comprising a vibration device coupled to the amusement device to produce vibrational motion of the three dimensional figure.

28. The amusement device as recited in claim 18, wherein the rubber sheath provides a paintable surface.

29. The amusement device as recited in claim 18, wherein the rubber sheath includes a molded image having three-dimensional molded details.

30. The amusement device as recited in claim 29, wherein the three-dimensional details include at least one of body features, personal effects and appendages.

31. The amusement device as recited in claim 18, wherein the three dimensional figure includes a molded image of one of a human, an animal, a mythical character, a cartoon character, and a comic character.

32. The amusement device as recited in claim 18, further comprising rigid parts attached to the rubber sheath.

33. The amusement device as recited in claim 18, further comprising collapsible molded features connected to the rubber sheath.

34. The amusement device as recited in claim 33, wherein the collapsible molded features include air holes to permit recovery of the collapsible molded features when the three dimensional figure is released.

* * * * *